US007064774B2

(12) United States Patent
Revelles

(10) Patent No.: US 7,064,774 B2
(45) Date of Patent: Jun. 20, 2006

(54) THERMAL TRANSFER LABEL PRINTER WITH REWIND CONTROL, AND METHOD FOR MULTIPLE LABEL PRINTING

(76) Inventor: Miguel Cancer Revelles, Carrer Alemanya, 9 esc. C 1°- 4, 08201 Sabadell Barcelona (ES)

( * ) Notice: Subject to any disclaimer, the term of this patent is extended or adjusted under 35 U.S.C. 154(b) by 99 days.

(21) Appl. No.: 10/702,175

(22) Filed: Nov. 5, 2003

(65) Prior Publication Data

US 2004/0141048 A1 Jul. 22, 2004

(30) Foreign Application Priority Data

Nov. 5, 2002 (ES) ..... 200202531

(51) Int. Cl.
*B41J 2/325* (2006.01)

(52) U.S. Cl. ..... 347/215

(58) Field of Classification Search ..... 347/215, 347/217, 218, 219; 400/120.02, 120.13, 400/249, 615.2, 618, 691
See application file for complete search history.

(56) References Cited

U.S. PATENT DOCUMENTS 4,586,834 A * 5/1986 Hachisuga et al. .... 400/120.13
5,318,369 A * 6/1994 Ishii ..... 400/249
5,725,318 A * 3/1998 Yamaguchi et al. ... 400/120.02
5,846,002 A 12/1998 Buckby
6,116,796 A * 9/2000 Yamaguchi et al. ..... 400/615.2
6,231,253 B1 * 5/2001 Henderson et al. ..... 400/618
6,428,227 B1 * 8/2002 Petteruti et al. ..... 400/691
6,778,201 B1 * 8/2004 Rother ..... 347/217
2004/0114024 A1 * 6/2004 Bouverie et al. ..... 347/219

FOREIGN PATENT DOCUMENTS

WO PCT/03/02013 9/2002

* cited by examiner

*Primary Examiner*—K. Feggins
(74) *Attorney, Agent, or Firm*—James Faier; Martin Faier; Faier & Faier P.C.

(57) ABSTRACT

This label has a printing head (1) which may be stationary or mob vale along a guide (2), a ribbon (3) bearing a printing medium, a ribbon pay-out spool (4), a ribbon tale-up spool (5) driven by a stepper motor (6), a control device (8) that governs the printing head (1), and a means for controlling the advance of the ribbon, (3). Said means for controlling the advance of the ribbon (3) comprises a device (7) for detecting the spin of the pay-out spool (4) and sending a signal to the control device (8) that reports on the spinning of the pay-out spool (4) when the stepper motor (6) makes the take-up spool (5) spin at a certain rate. The invention also includes a method for using this label printer for multiple label printing.

1 Claim, 3 Drawing Sheets

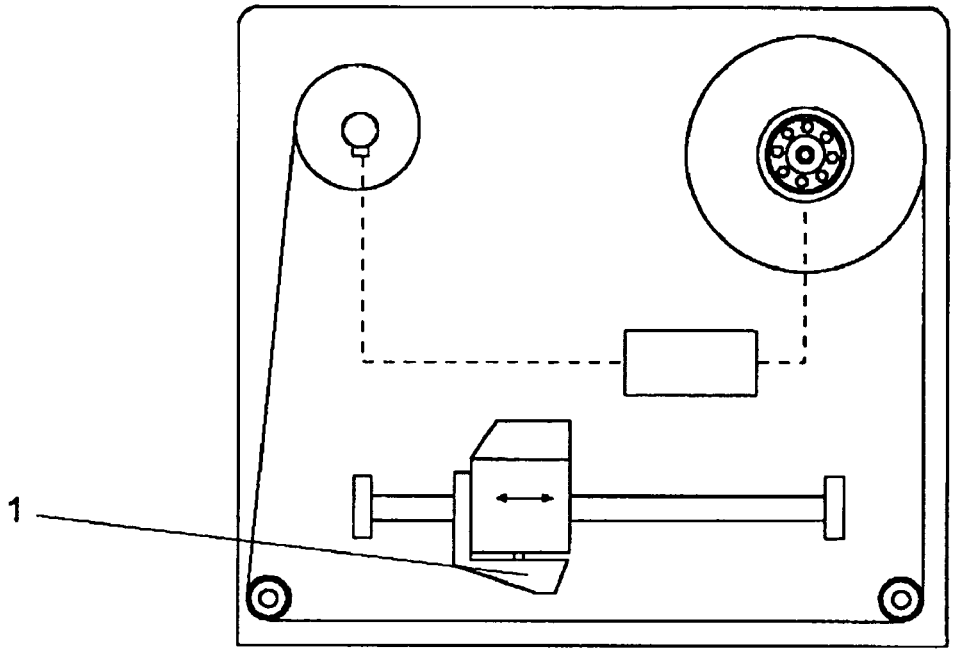
Fig. 2
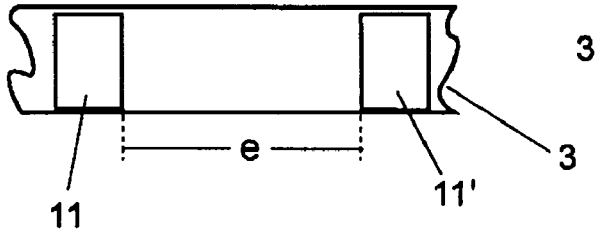
Fig. 3
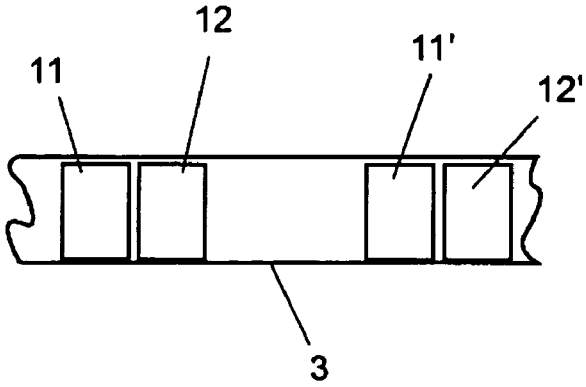
Fig. 4
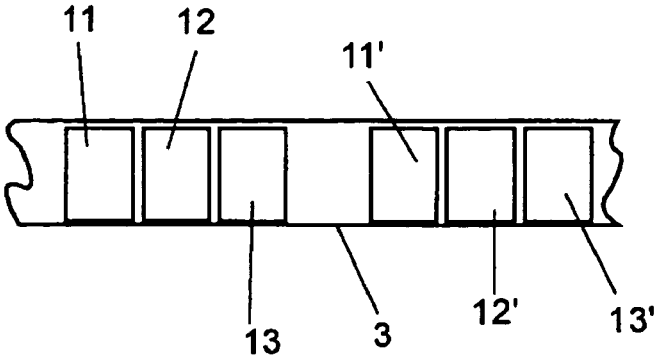

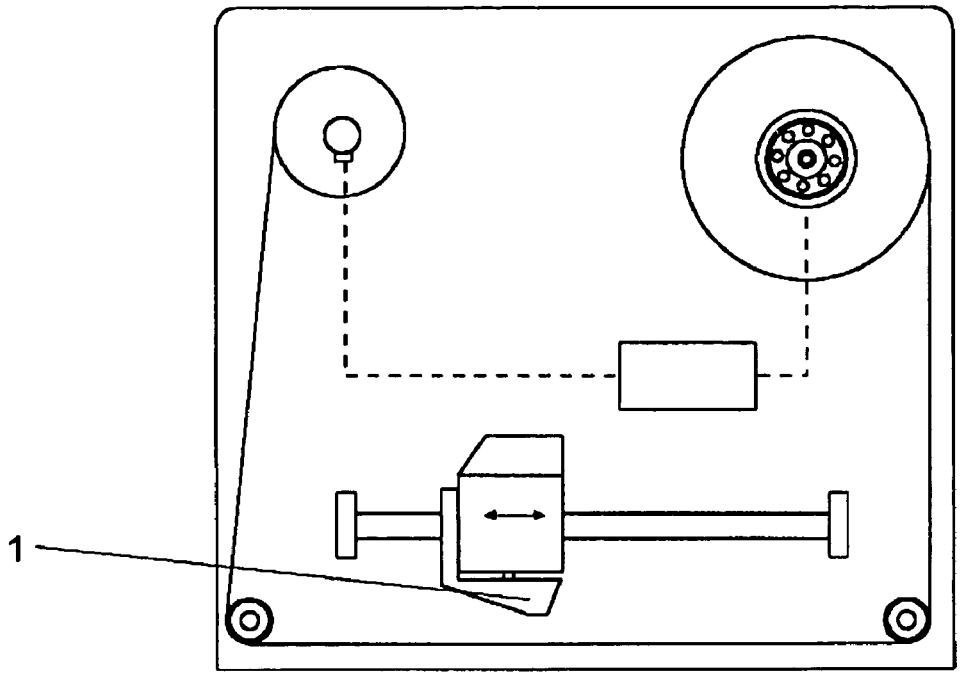
Fig. 5
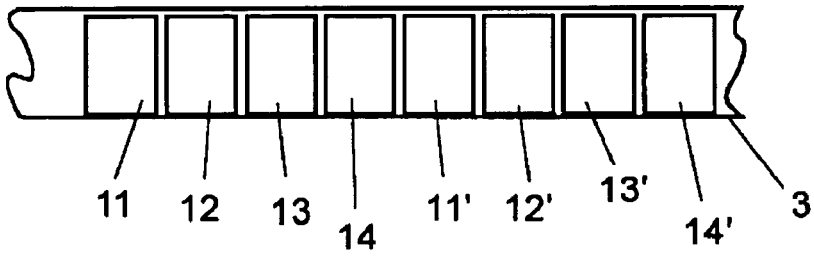
Fig. 6
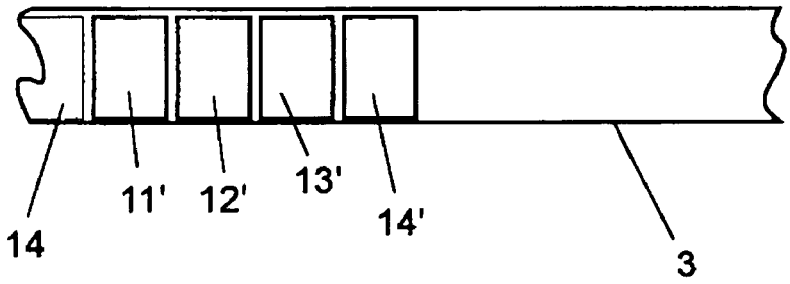

THERMAL TRANSFER LABEL PRINTER WITH REWIND CONTROL, AND METHOD FOR MULTIPLE LABEL PRINTING

OBJECT OF THE INVENTION

This invention refers to a thermal label printer with rewind control, of the kind with a printing head, a ribbon bearing a printing medium, a pay-out spool supplying the ribbon, a take-up spool collecting the ribbon again and driven by a stepper motor, a control device controlling the printing head and a means for controlling the advance of the ribbon from the pay-out spool to the take-up spool. The invention also includes a method for multiple label printing using this label printer.

BACKGROUND OF THE INVENTION

The label printers of the kind mentioned are frequently used for printing labels on the reel, where one of the objectives of manufacturers of such label printers is to achieve the most efficient use of the ribbon used in printing in order to optimize the costs of the label-printing operation.

This entails equipping the label printer with means for controlling the advance of the ribbon, and making the resultant information available to a control device that controls the movements of the printing head and the take-up or advance rate of the ribbon.

In some label printers, a pull-roller unit is used to advance the ribbon in order to achieve accurate winding. Such accurate tangential ribbon pulling is achieved by controlling the pull-roller unit, though this requires a mechanism that is subject to wear and tear and requires maintenance owing to friction.

Other label printers arrange ribbon advance through simpler mechanical means, by having the take-up spool driven directly, where the rotation of said spool is controlled. This technique poses problems of inaccuracy in calculating the advance of the ribbon, since the linear travel of the ribbon depends not just on the rotation of the take-up spool but also on the radius of said take-up spool, and that radius becomes larger as the amount of ribbon wound around the take-up spool increases.

Also known, through patent JP-A-61-199972, is the technique of detecting ribbon movement all along the feed path of the ribbon to offset changes in the radius of the take-up spool, though that patent describes a label printer with a stationary printing head rather than a movable one.

A description is given in patent EP 76907576 or ES 2 132 902 of a method for calibrating a ribbon-winding mechanism for a printing device in which the ribbon is advanced by means of a stepper motor acting on the ribbon take-up spool. In that patent, the calibration is arranged by using a means of detection that measures ribbon advance when the take-up spool is turned, where the means of detection is connected to a control device. The means of detection comprises a free-spinning roller or 'idler' that is kept in contact with the ribbon and has a magnetic, optical or other such system for sending the necessary information about the advance or linear travel of the ribbon to a suitable receiver.

The use of this type of idler can give rise to problems if the ribbon slips on the roller—which can happen when the printing device is used in a packaging area, especially when the product to be packaged is powdered and features a low friction coefficient. In this case, the ribbon can slip or slide over the idler, making it turn irregularly or not at all, giving a completely false measurement of ribbon advance.

As mentioned above, this aim of attaining an accurate measurement of the ribbon's advance has a decisive influence on both the efficient use of the ribbon and on successful labelling or printing, since if ribbon advance is not perfectly controlled, a section of the ribbon that has already been used may be used again for printing another label, thus giving defective or incomplete printing.

In general, such label printers perform the thermal transfer of the ribbon's printing medium onto the surface to be labelled at a rate of one label per cycle, and making the ribbon advance between each printing action.

In cases where the printing of more than one label per cycle is required, this technique usually entails an excessively inefficient use of the printing ribbon, thus making the labelling process more costly.

DESCRIPTION OF THE INVENTION

To solve the problems explained above, the thermal transfer printer of this invention, with winding control and a method for multiple label printing, was conceived to provide reliable control over ribbon advance, achieve optimum efficiency in the use of the printing ribbon, ensuring the use of each section of the ribbon in a single printing, and to reduce significantly the number of movements made by the head in moving to and from the ribbon.

The label printer of this invention is of the kind that has a printing head, which may be moving or stationary, a ribbon bearing a printing medium, a pay-out spool to supply the ribbon, a take-up spool driven by a stepper motor to collect the ribbon, a control device that controls the printing head, and a means for controlling the advance of the ribbon from the pay-out spool to the take-up spool.

In this invention, the means used to control ribbon advance comprises a device that detects the spin of the ribbon pay-out spool and sends the control device a signal reporting the spin of the pay-out spool when the stepper motor makes the take-up spool spin at a particular rate. Said control device then determines the linear advance of the printing ribbon on the basis of the spin rate of the motor, the spin of the ribbon pay-out spool and the initial radius of the reel of ribbon fitted onto the pay-out spool.

Having the spin-detection device fitted as part of the ribbon pay-out spool affords major advantages with regard to the known systems mentioned above, chief among them being the simplicity of the assembly and the reliability of the spin detection reported by the pay-out spool, since said spin rate is transmitted directly from the ribbon pay-out spool to the spin detection device, ruling out any possibility of the ribbon slipping or sliding as can occur when an idler is used to detect the advance of the ribbon.

The spin-detection device fitted at the pay-out spool can also be used for detecting the radius of the take-up spool provided that the total quantity of ribbon lying between the take-up spool and the pay-out spool is known. Since the ribbon used is not destroyed—for it passes from the pay-out spool to the take-up spool—the total quality of ribbon remains constant and equal to the amount of ribbon existing at the start of operations.

Under these conditions, the radius of the take-up spool has a one-to-one relationship with the steps of the take-up spool's stepper motor between each successive detection made by the device for detecting the spin rate of the pay-out spool. Through knowing the radius of the take-up spool, the ratio needed for turning angular measurements into linear ones is also known—i.e. the angle for translating motor-steps into millimeters-of-advance of the ribbon.

In short, the radius of the take-up spool depends on the initial radius of the reel in the pay-out spool—i.e. its radius before it began to be used—and the number of steps made by the motor associated with the take-up spool between any two detection phases of the detection device associated with the pay-out spool.

Thus the only problem posed is determining the initial radius of the ribbon pay-out spool, which can be solved by always fitting ribbon reels of the same size, or by fitting a new spindle in the take-up spool whenever the reel on the ribbon pay-out spool is changed.

In 99% of cases, the control device is capable of detecting any change in reel made by the client, since the value memorized for the number of steps made by the motor between any two consecutive detection actions of the pay-out spool's spin detection device will be different from the value detected for the new reel. Accordingly, through knowing the radius of the new spindle (which is always fixed), the initial radius of the pay-out spool can easily be found.

When the initial radius of the pay-out reel is known, the radius of the take-up spool depends on the number of steps made by the motor between two detection actions of the pay-out spool's spin-detection device; hence, by detecting said number-of-steps of the stepper motor at any time, the radius of the take-up spool can be found through its one-to-one relationship.

This label printer, by using reliable data such as the spin induced in the take-up spool by the stepper motor between two consecutive detection phases of the spin-detection device associated with the pay-out spool, plus the data for the initial radius of the ribbon reel fitted in the ribbon pay-out spool, enables the means of control to compute very accurately, using suitable software, the advance of the printing ribbon, regardless of whether the printing head is stationary or longitudinally movable.

This strict control of ribbon advance enables this label printer, when fitted with a movable printing head, to use a multiple label printing method as per the characteristics described in the claims, thus bringing a number of advantages, such as optimum efficiency in the use of the printing ribbon, greater printing speed, and a significant reduction in the number of movements made by the printing head in moving towards and away from the ribbon, thus significantly reducing printing-head movements and resulting in minimum wear and tear of the printing ribbon.

DESCRIPTION OF THE FIGURES

To supplement the description provided here, and in order to facilitate understanding of the characteristics of the invention, a set of drawings is attached to this specification which, for illustrative but non-restrictive purposes, show the following:

FIG. 2 is a diagram with an elevation view of the printing head and, below it, a plan view of a section of the ribbon showing the sections of the ribbon used to arrange multiple printing through a single printing-head pass.

FIGS. 3, 4, 5 and 6 are plan views of the above section of tape showing the areas of the ribbon used for arranging multiple printing actions in each advance of the head in accordance with the method of this invention. The label printer is included again in FIG. 5 to show the relative position of the printing head.

PREFERRED EMBODIMENT OF THE INVENTION

Figure 1:
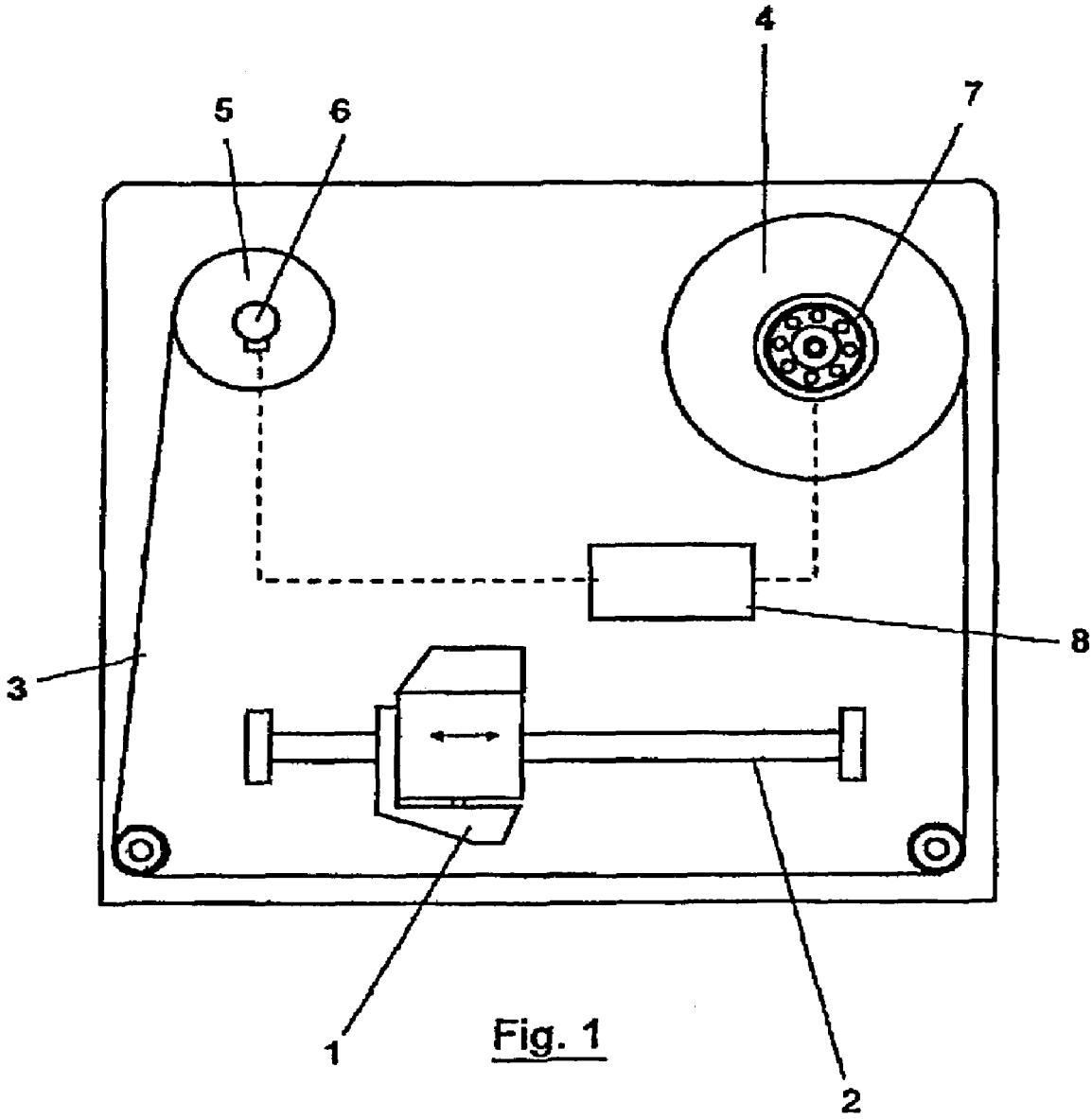
FIG. 1 is a diagram of the improved label printer showing the means used to control the advance of the ribbon and the printing head, where the latter is movable.

As can be seen in FIGS. 1 and 2, the label printer shown in this example embodiment comprises: a printing head (1) that travels on a guide (2), a ribbon (3) bearing a printing medium, a ribbon pay-out spool (4), a ribbon take-up spool (5), a stepper motor (6) to make the take-up spool (5) spin, a spin-detection device (7) detecting the spin of the ribbon pay-out spool (4), the device being represented in this example embodiment by an encoder, and a control device (8).

The spin-detection device (7) and the stepper motor (6) are connected to the control device (8), the task of the latter being to ascertain the linear advance of the printing ribbon (3) on the basis of the motor spin rate (6) and thus the spin rate of the take-up spool (5), the spin of the pay-out spool (4), and the initial radius of the reel of printing ribbon (3) fitted on the pay-out spool (4).

This control over the linear advance of the printing ribbon (3) enables the label printer to use the multiple label printing method described here:

In the first stage, the label printer brings the printing head (1) towards the ribbon (3), said head (1) advancing along the guide (2) to print two initial labels consecutively by the thermal transfer of the printing medium at zones (11, 11') of the ribbon (3) onto the product to be labelled, leaving a space (e) between zones (11 and 11') of the ribbon that is longer than one of those zones (11 or 11'), In the second stage, the control device (8) makes the printing head (1) move away from the ribbon (3) and travel back along the guide (2) to its initial position, while the ribbon (3) advances along a distance that is equal to or slightly longer than one of the zones (11 or 11') of ribbon already used.

By repeating these stages, as shown in FIGS. 3, 4 and 5, the label printer, in each successive pass of the head (1) over the guide (2), consecutively prints several pairs of labels by the thermal transfer of the printing medium at zones (12, 12'), (13, 13') (14, 14'), with the largest possible of the used zones (12, 13, 14) and is left in space (e) of the ribbon. The maximum number of printing actions to be made using area (e) of the ribbon—three in this example—is calculated by the control device (8) on the basis of the length of said printing actions and the space (e) existing between the zones (11. 11') of the ribbon already used for the first printing actions.

After using zones (11, 12, 13, 14, 11', 12', 13' and 14') of the ribbon (1) for arranging the relevant printing actions, the control device (8) arranges the advance of a length of ribbon (3) that is slightly longer than the ribbon occupied by the used zones (11', 12', 13' and 14'), as shown in FIG. 6, so that the label printer, in its various printing-head (12) passes, can perform further printing actions by repeating the above method.

Having sufficiently covered the nature of the invention, together with a preferred embodiment thereof, it is set on record for all corresponding effects and purposes that the materials, form, size and layout of the items described can be modified, provided that such modification does not alter the essential characteristics of the invention as claimed hereunder.

The invention claimed is:

1. A method for multiple label printing with a thermal-transfer label printer with rewind control, of the kind that comprises a printing head (1), which is movable along a guide (2), a ribbon (3) bearing a printing medium intended to be thermally transferred by the printing head onto the product to be labeled during the labeling operation, a ribbon pay-out spool (4), a ribbon take-up spool (5) driven by a stepper motor (6), a control device (8) that governs the printing head (1), and a means for controlling the advance of the ribbon (3) from the pay-out spool (4) to the take-up spool (5), where the ribbon (3) follows a path that is parallel to the printing head (1) during an intermediate stage of its path as a whole; characterized in that the means for controlling the advance of the ribbon (3) comprises a device (7) for detecting the spin of the pay-out spool (4) and sending a signal to the control device (8) that reports on the spinning of the pay-out spool (4) when the stepper motor (6) makes the take-up spool (5) spin at a certain rate, and said control device (8) then computes the linear advance of the printing ribbon (3) on the basis of the spinning of the stepper motor (6), the spinning of the ribbon pay-out spool, and the initial radius of the ribbon reel (3) fitted in the pay-out spool (4), and wherein said printing method is further characterized in that it comprises the following stages:

a) the approach of the printing head (1) to the ribbon (3) and the advance of that head along its guide (2) in order to print the initial labels consecutively through the thermal transfer of the printing medium at zones (11, 11') of the ribbon onto the product to be labeled, leaving a space (e) between the used zones (11 and 11') of the ribbon that is longer than one of those zones (11 or 11');

b) the moving of the printing head (1) away from the ribbon (3) and the head's return along its guide (2) to its initial position, while the ribbon (3) advances over a distance that is slightly longer than one of the used zones (11 or 11') on the ribbon (3);

c) the calculation by the control device (2) of the maximum number of printing actions to be performed using space (e) on the ribbon, on the basis of the length of said printing actions and of the space (e) between the zones (11, 11') of the ribbon used for the earlier printing actions;

d) the repetition of stages a) and b) to arrange, through successive travel runs by the printing head (1), the consecutive printing of several groups of labels by the thermal transfer of the printing medium existing in zones (12, 12'), (13, 13') (14, 14'), leaving the largest possible number of used zones (12, 13, 14) within space (e);

e) the advance, under the control of the control device (8) of a length of ribbon (3) that is slightly longer than the length occupied by the used zones (11', 12', 13' and 14') of the ribbon (3), so that the label printer, in its various printing-head (1) passes, can perform further printing actions by repeating the above stages.

* * * * *